US008491344B2

(12) United States Patent
Ishibashi

(10) Patent No.: US 8,491,344 B2
(45) Date of Patent: Jul. 23, 2013

(54) CONNECTOR

(75) Inventor: Takeshi Ishibashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/293,625

(22) Filed: Nov. 10, 2011

(65) Prior Publication Data

US 2012/0149240 A1 Jun. 14, 2012

(30) Foreign Application Priority Data

Dec. 13, 2010 (JP) ..... 2010-277095

(51) Int. Cl.
*H01R 13/40* (2006.01)

(52) U.S. Cl.
USPC ..... 439/752.5

(58) Field of Classification Search
USPC ..... 439/595, 751, 752, 752.5, 744
See application file for complete search history.

(56) References Cited

U.S. PATENT DOCUMENTS

| | | | | |
|---|---|---|---|---|
| 7,661,987 | B2 * | 2/2010 | Adachi et al. | 439/595 |
| 8,011,977 | B2 * | 9/2011 | Tsuruta et al. | 439/752 |
| 8,257,107 | B2 * | 9/2012 | Tsuruta et al. | 439/362 |
| 8,298,022 | B2 * | 10/2012 | Tsuruta et al. | 439/886 |
| 2009/0186512 | A1 * | 7/2009 | Adachi et al. | 439/350 |
| 2011/0053403 | A1 * | 3/2011 | Tsuruta et al. | 439/345 |
| 2011/0053404 | A1 * | 3/2011 | Tsuruta et al. | 439/345 |
| 2012/0149226 | A1 * | 6/2012 | Ishibashi | 439/271 |
| 2012/0149240 | A1 * | 6/2012 | Ishibashi | 439/595 |

FOREIGN PATENT DOCUMENTS

JP 5-343122 12/1993

* cited by examiner

*Primary Examiner* — Ross Gushi
(74) *Attorney, Agent, or Firm* — Gerald E. Hespos; Michael J. Porco; Matthew T. Hespos

(57) ABSTRACT

A connector (10) has a housing (11) with a cavity (13) and a terminal fitting (30) accommodated inside the cavity (13). A locking strip (37B) projects out on the terminal fitting (30). An inner surface of the cavity (13) has an erroneous insertion prevention part (22A) that engages the locking strip (37B) when the terminal fitting (30) is inserted into the cavity (13) in a posture erroneous in an orientation about an axis thereof, thus preventing erroneous insertion of the terminal fitting (30) into the cavity (13).

15 Claims, 11 Drawing Sheets

CONNECTOR

BACKGROUND OF THE INVENTION

1. Field of the Invention

The invention relates to a connector.

2. Description of the Related Art

Hybrid cars and electric cars have an inverter and a battery that are connected to each other by a power electric wire that has connectors at respective ends thereof. Each connector has a terminal fitting connected with the end of the electric wire. The terminal fitting is inserted into the insertion hole or cavity of a connector housing. A lance projects radially from the periphery of the terminal fitting and is locked to the end surface of a hole formed orthogonally to the insertion hole.

The terminal fitting should be inserted into the cavity in a normal posture. However, there is a fear that the terminal fitting can be accommodated inside the cavity in an erroneous posture (e.g. inverted) and hence the lance will not lock to the hole in the cavity.

The invention has been completed in view of the above-described situation. Thus it is an object of the invention to prevent a terminal fitting from being accommodated in a cavity in an erroneous posture or orientation about the axis thereof.

SUMMARY OF THE INVENTION

The invention relates to a connector comprising a housing with a cavity and a terminal fitting accommodated in the cavity. The terminal fitting has an outwardly projecting locking strip and an inner surface of the cavity has an erroneous insertion prevention part that engages the locking strip when the terminal fitting is inserted into the cavity in an erroneous posture or orientation about an axis thereof, thereby preventing erroneous insertion of the terminal fitting into the cavity.

At least one of a peripheral surface of the terminal fitting and the inner surface of the cavity may be round. A lance preferably projects from the inner surface of the cavity and the terminal fitting preferably has an engagement part that engages the lance when a force in a removal direction is generated. The inner surface of the cavity preferably has a rotation prevention part to be locked to the locking strip when the terminal fitting is accommodated in the cavity, thus preventing the terminal fitting from rotating more than a predetermined amount about the axis. As a result, the terminal fitting cannot rotate into a position where the engagement part no longer engages the lance. Therefore positive locking of the terminal fitting in the cavity is assured.

The rotation prevention part preferably extends from a position corresponding to the position of the locking strip of the properly inserted terminal fitting to a predetermined position toward an insertion opening of the cavity. Thus, the rotation prevention part functions as a guide for inserting the terminal fitting into the cavity.

The erroneous insertion prevention part and the rotation prevention part preferably are formed integrally on an inner surface of the housing. Thus, the erroneous insertion prevention part and the rotation prevention part can be formed easily.

The locking strip preferably has left and right parts. Thus, the locking strip can be locked easily to the erroneous insertion prevention part, and the erroneous insertion prevention part can be formed in a small angular region.

Two locking strips preferably are symmetrical in a left-to-right direction and incline up or down with respect to a horizontal direction. Thus, the locking strip easily engages the erroneous insertion prevention part when the terminal fitting is inserted into the cavity in an inverted posture.

The terminal fitting preferably has a terminal connection part to be connected to a mating male terminal fitting, a wire connection part to be connected to an electric wire, and a plate-shaped coupling continuous with the terminal connection part and the wire connection part. The locking strip preferably is integral with a side edge of the coupling. Thus, the locking strip can be formed easily while producing the terminal fitting.

DETAILED DESCRIPTION OF THE PREFERRED EMBODIMENTS

Figure 1:
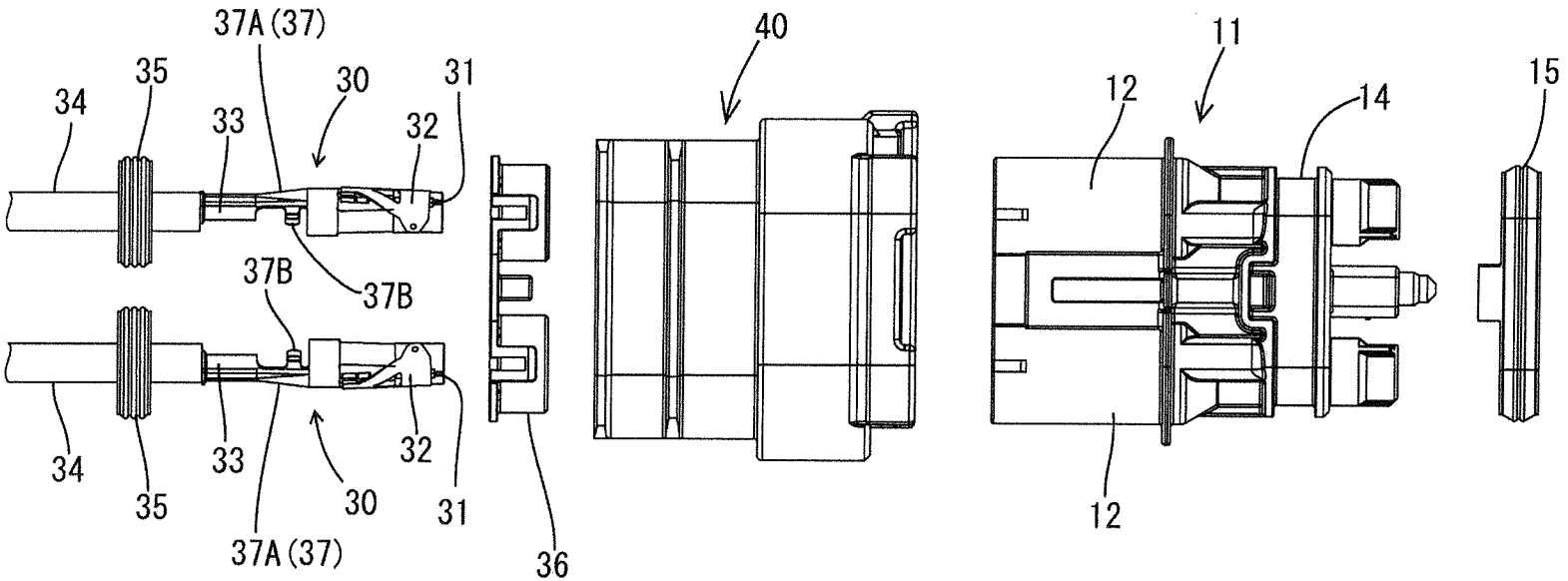
FIG. 1 is an exploded plan view showing a connector according to an embodiment of the present invention.
Figure 2:
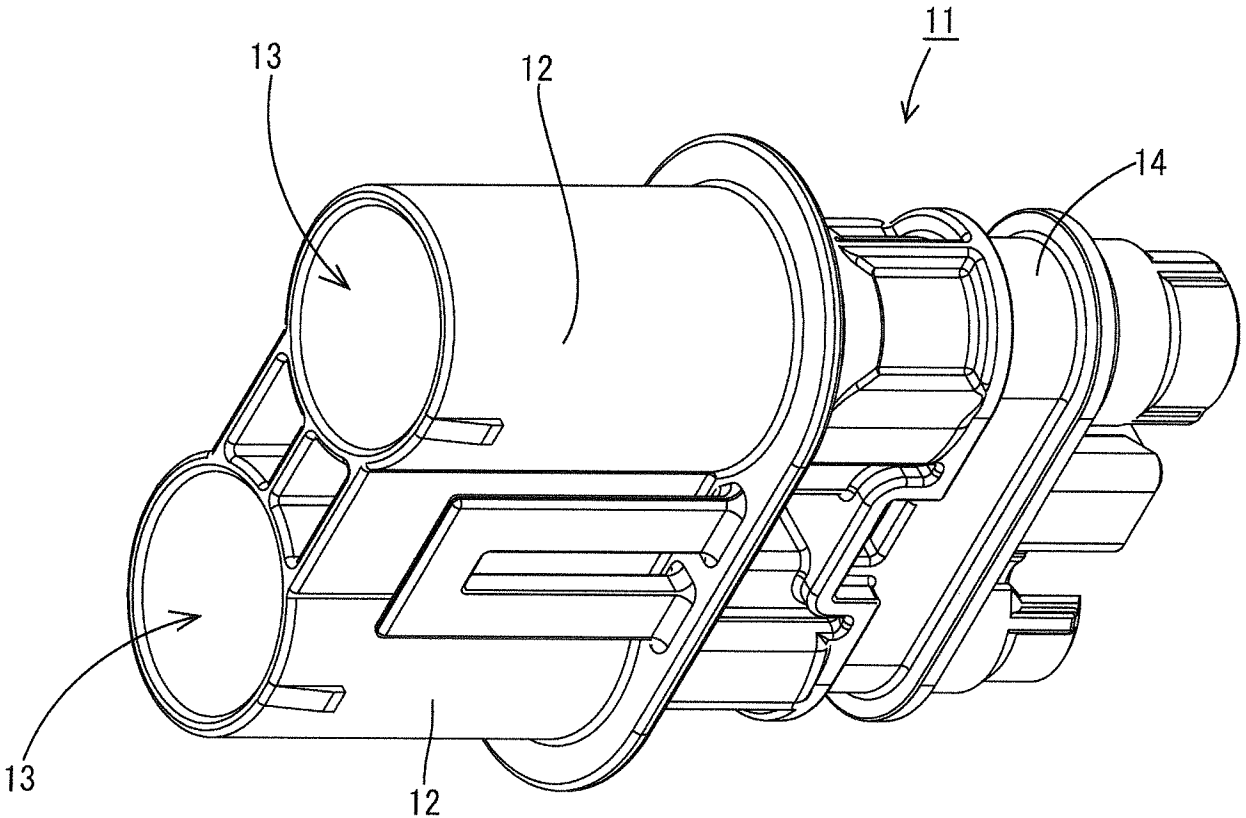
FIG. 2 is a perspective view showing a connector housing.
Figure 7:
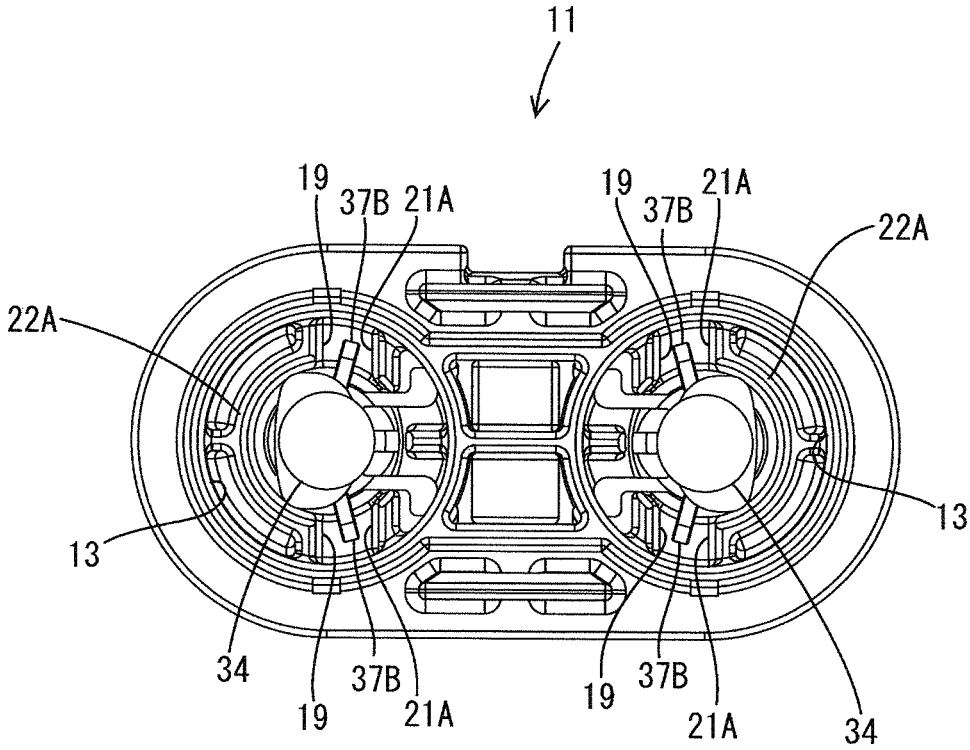
FIG. 7 is a rear view of FIG. 6.
Figure 8:
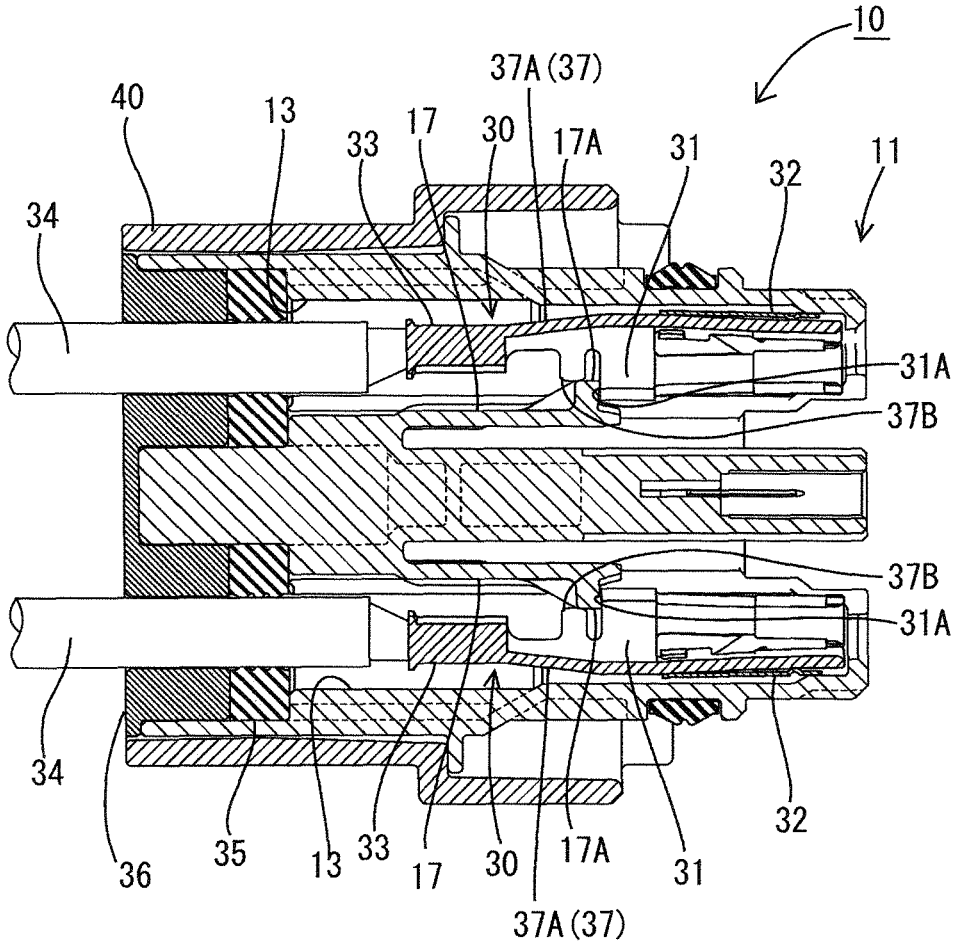
FIG. 8 is a sectional view showing the terminal fitting mounted in the housing.

A connector in accordance with the invention is identified by the numeral 10 in FIG. 8. The connector 10 is mounted on a car, such as a hybrid car or an electric car, and is disposed on a path for supplying an electric power between a battery and equipment, such as an inverter. The connector 10 is a female connector that can be fit on a mating male connector (not shown) fixed to a case of the equipment. In the following description, the left side in FIG. 1 is the front, whereas the right side is the rear. The vertical direction and the left-to-right direction correspond to the orientation of FIG. 7.

As shown in FIG. 1, the connector 10 has a housing 11 made of a synthetic resin, a terminal fitting 30 held by the housing 11, and a die-cast aluminum shielding shell 40 fit on the housing 11.

The housing 11 has two laterally spaced terminal fitting holding parts 12, 12, integral with each other and spaced at a predetermined distance. A cavity 13 is formed inside each terminal fitting holding part 12 and extends in the cavity 13 in the forward and backward direction of the housing 11.

Figure 4:
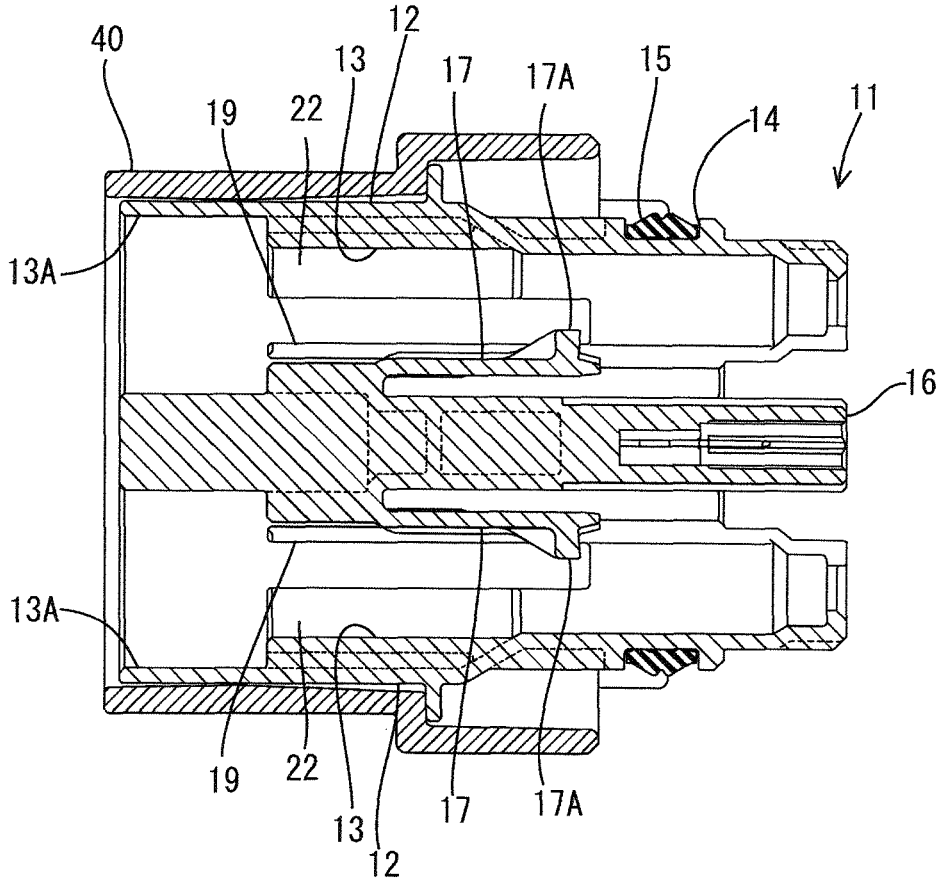
FIG. 4 is a sectional view with a shielding shell fit on the housing.

As shown in FIG. 4, each cavity 13 penetrates through the terminal fitting holding part 12 in the forward and backward direction of the housing 11 and has an insertion opening 13A at a rear end of the cavity 13 to receive the terminal fitting 30.

The cavity 13 has an approximately circular (round) cross section with an inner diameter that permits the terminal fitting 30 to move slightly in the vertical and left-to-right directions to allow a fit-on position of the terminal fitting 30 and a mating male terminal fitting to be adjustable.

An O-ring accommodation groove 14 is formed at a position near front ends of the terminal fitting holding parts 12, 12 where the terminal fitting holding parts 12, 12 are coupled to each other. A seal ring 15 is mounted in the O-ring accommodation groove 14.

A quadrangular prism-shaped interlocking fit-on part 16 is provided between the front ends of the terminal fitting holding parts 12 and is spaced from the terminal fitting holding parts 12 at a predetermined interval. A short-circuit terminal is disposed inside the interlocking fit-on part 16 to detect whether the interlocking part 16 has fit on an interlocking connector on the mating male connector, i.e., whether the connector 10 and the mating male connector have been fit together properly. More particularly, a fit-on detection circuit (not shown) detects when the connector 10 has been fit on the mating male connector and closes a relay so that a power circuit can be energized.

A lance 17 is cantilevered forward from the side of each cavity 13 nearest the interlocking fit-on part 16 and is elastically deformable toward the interlocking fit-on part 16. A locking projection 17A is formed at the front end of the lance 17 and projects into the cavity 13. As shown in FIG. 8, the locking projection 17A of the lance 17 engages a rear edge 31A of a terminal connection part 31 of the terminal fitting 30 and prevents the terminal fitting 30 from being removed from the cavity 13.

A space for receiving the elastically deformed lance 17 is formed between the lance 17 and the interlocking fit-on part 16. The lance 17 is deformed when the terminal fitting 30 is not locked properly to the lance 17. Thus, the mating connector contacts the deformed lance 17 during a connecting operation to inhibit further connection. Thus an operator can immediately detect a defective locking state.

Figure 5:
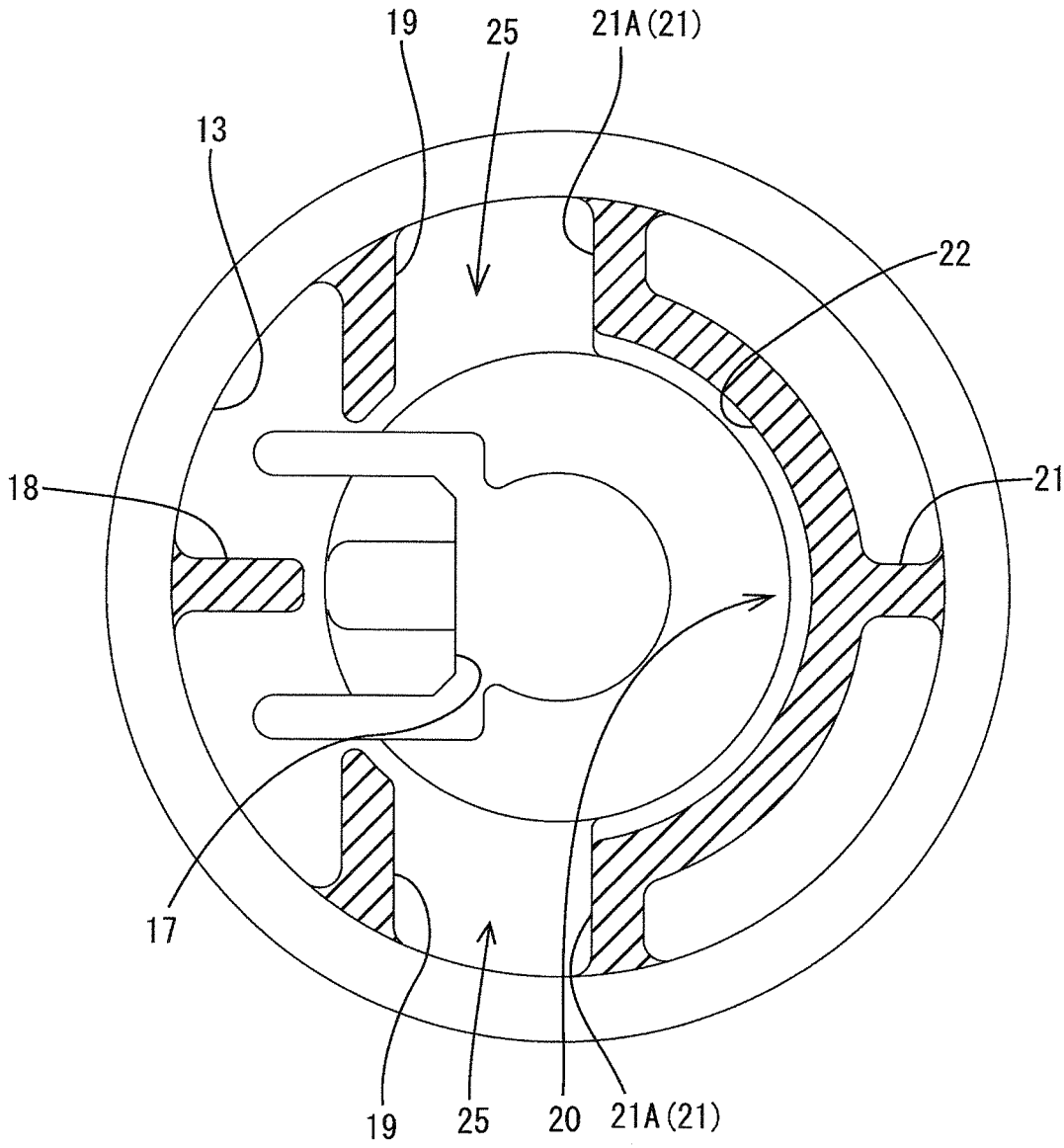
FIG. 5 is an enlarged rear view of a cavity of the housing.
Figure 6:
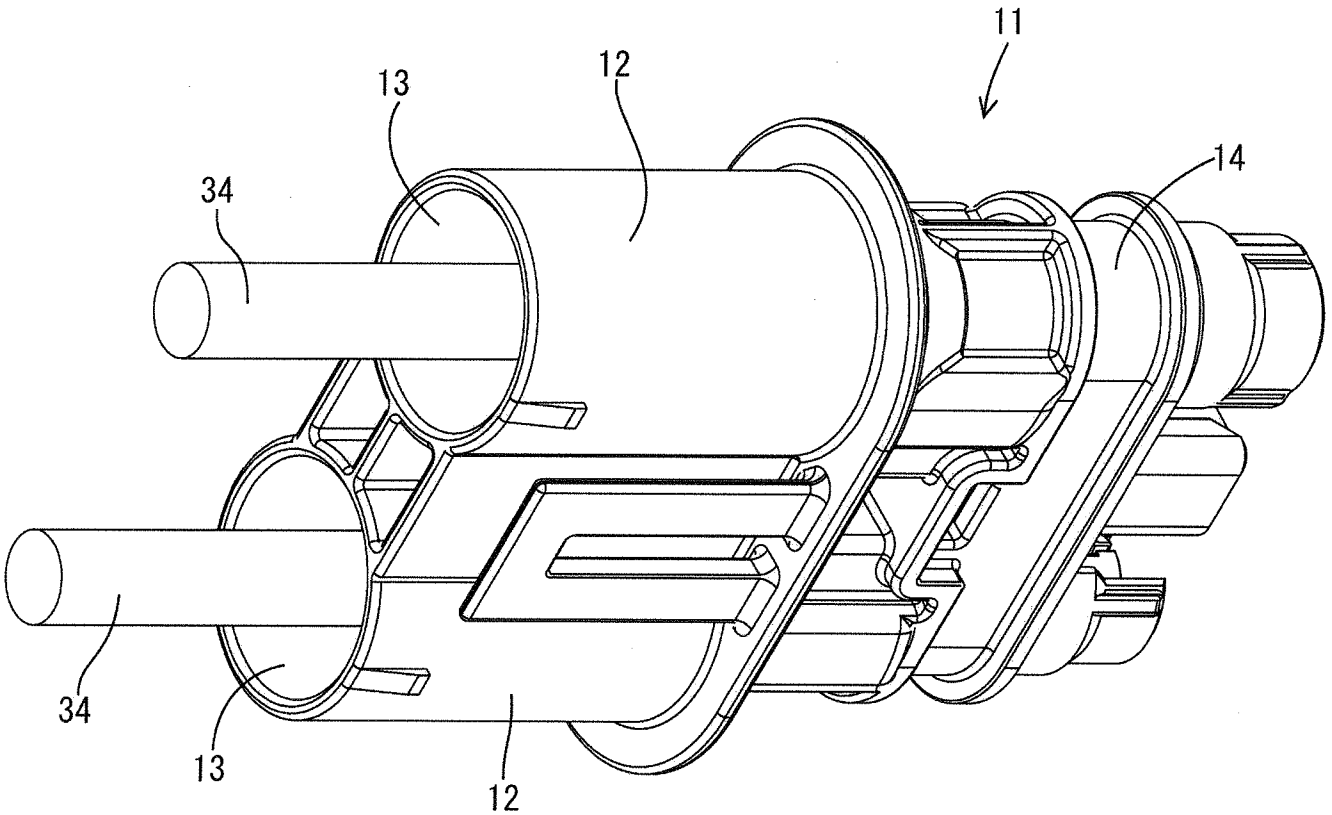
FIG. 6 is a perspective view showing a terminal fitting connected to an electric wire mounted in the housing.

Inwardly projecting ribs 18 through 20 are formed on the inner surface of each cavity, as shown in FIG. 5. The ribs 18 through 20 include a guide rib 18 formed at an innermost side (left side in FIG. 5) of the cavity 13, upper and lower first rotation prevention parts 19, 19 formed at an outer side (right side in FIG. 5) of the cavity 13 at a predetermined dimension from the guide rib 18, and a semi-cylindrical coupling rib 20 formed in a region occupying about the half of the cavity 13 at the outer side thereof (half of the cavity 13 at the right side thereof).

The guide rib 18 is disposed rearward from the lance 17. The guide rib 18 projects in at a position located forward by a predetermined distance from the rear edge of the cavity 13 and extends with a uniform thickness to the vicinity of a proximal portion of the lance 17. Thus, the terminal fitting 30 can be guided into the cavity 13 without the front end of the terminal fitting 30 contacting a step at the proximal portion of the lance 17.

Figure 11:
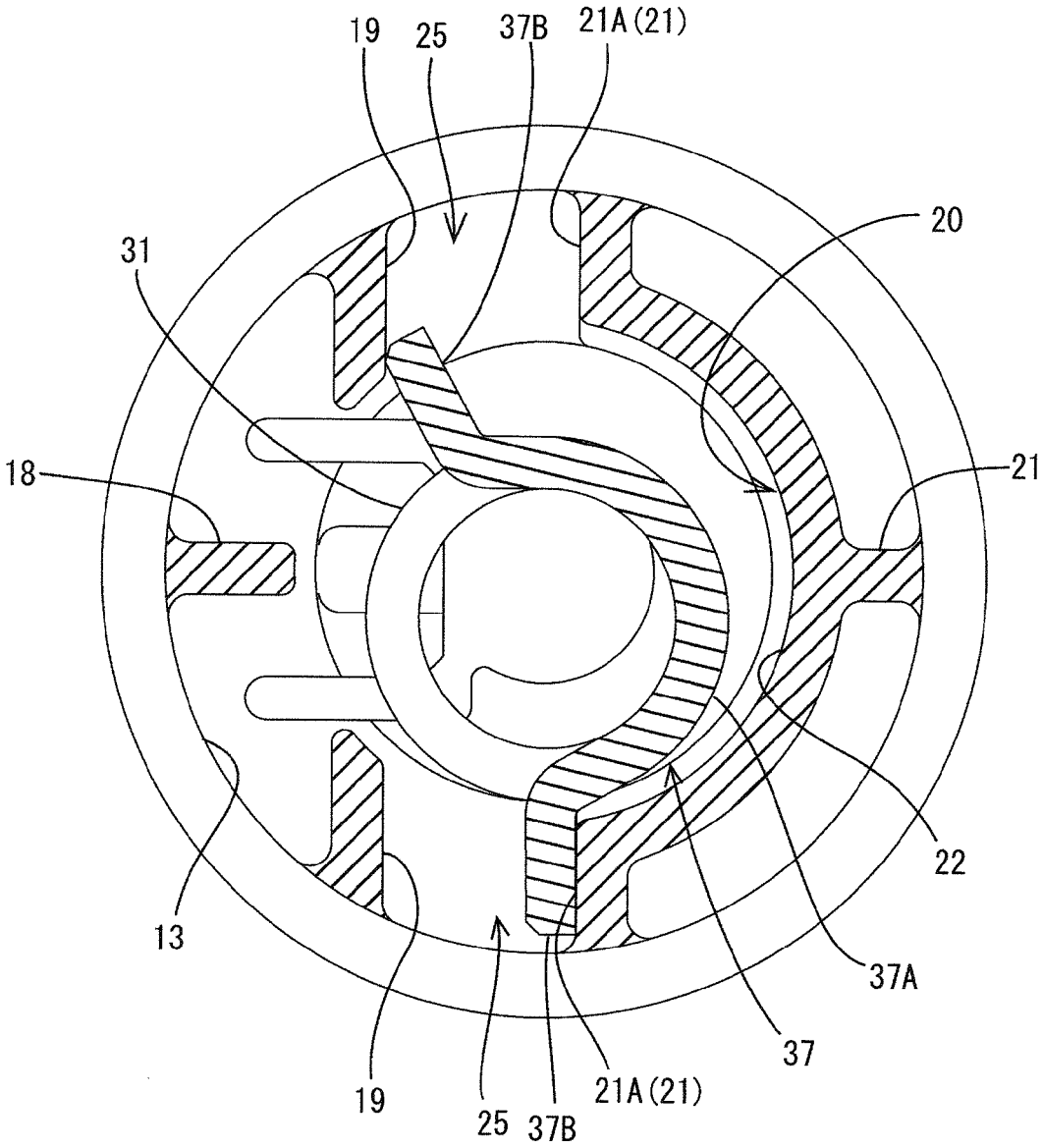
FIG. 11 shows a state in which the terminal fitting rotates at a predetermined angle inside the cavity.

The first rotation prevention parts 19 project up and down respectively at equivalent positions in the left-to-right direction to such an extent to engage a locking strip 37B of the terminal fitting 30 and thereby inhibiting rotation (see FIG. 11). The first rotation prevention parts 19 are sufficiently thick to withstand the force required to lock the locking strip 37B thereto when the terminal fitting 30 rotates. Leading ends of the first rotation prevention parts 19 are beveled at the side opposite the interlocking fit-on part 16.

The coupling rib 20 projects in a semi-cylindrical shape from the inner surface of the cavity 13 at the side opposite the interlocking fit-on part 16. The coupling rib 20 has three inwardly projecting supports 21 that are spaced from one another at equal angular intervals and an annular coupling 22 that connects inner ends of the supports 21. The annular coupling 22 defines a circular arc along the inner surface of the cavity 13.

The upper and lower supports 21 are at equivalent positions in the left-to-right direction are define second rotation prevention parts 21A that engage the locking strip 37B to prevent rotation of the terminal fitting 30. A pass-through part 25 is formed between the first and second rotation prevention parts 19 and 21A for receiving the locking strip 37B of the terminal fitting 30.

The terminal fitting 30 intentionally is made movable to some extent inside the pass-through part 25. More particularly, the mating terminal fitting at the equipment side is fixed firmly and there is a fear that a firmly fixed female terminal fitting 30 would collide with the front end of the mating male terminal fitting at a position other than the specified contact position. Thus, the female terminal fitting 30 is fit loosely in the terminal fitting holding part 12. More particularly, the terminal fitting 30 and the cavity 13 are round. Thus, the terminal fitting 30 can rotate in response to a rotational force (twist) applied to the terminal fitting 30 from an electric wire 34 or from a mating terminal fitting. The range of permissible movement of the terminal fitting 30 is defined by the dimensions of the pass-through part 25 and the locking strip 37B. The ability of the terminal fitting 30 to rotate prevents a potentially damaging collision between the terminal fitting 30 and the mating terminal fitting during connection.

Figure 3:
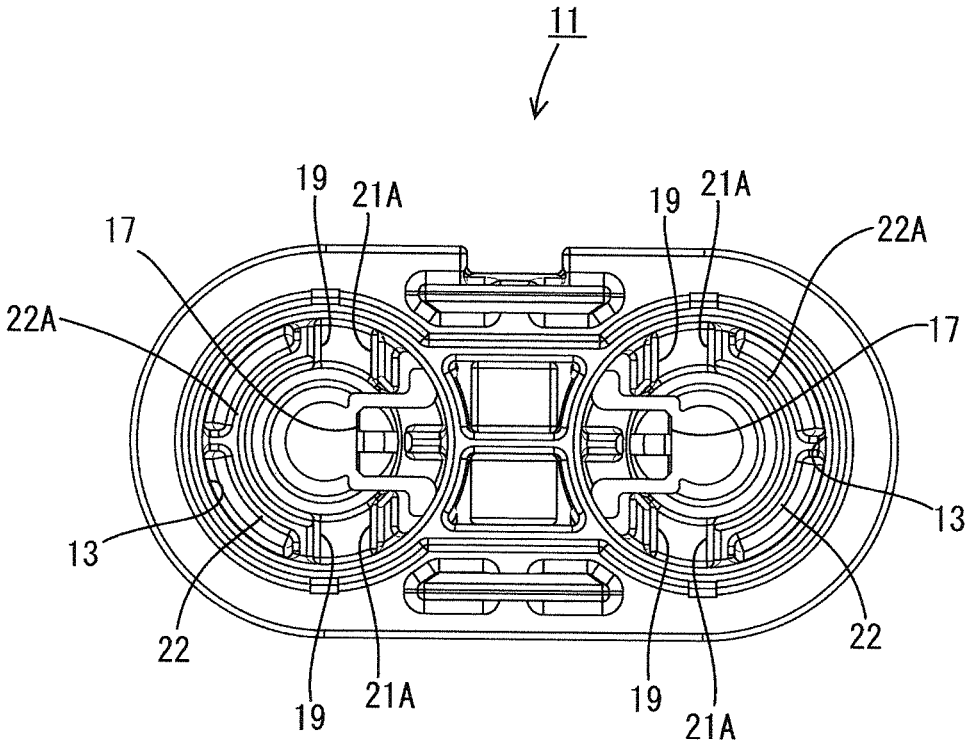
FIG. 3 is a rear view showing the connector.

The rear end (see FIG. 3) of the annular coupling 22 functions as an erroneous insertion prevention part 22A and contacts a front surface of the locking strip 37B if the terminal fitting 30 is attempted to be inserted into the cavity 13 in a rotationally incorrect orientation (e.g. inverted), thus preventing erroneous insertion of the terminal fitting 30 into the cavity 13.

The ribs 19, 20 extend from a position near the rear end of the cavity 13 to a position adjacent the locking strip 37B of the properly inserted terminal fitting 30 (the position shown in FIG. 8). Thus, the locking strip 37B slides between the first and second rotation prevention parts 19 and 21A to guide the terminal fitting 30 during insertion into the cavity 13.

As shown in FIG. 8, the terminal fitting 30 has a cylindrical terminal connection part 31 to be connected to a mating male terminal fitting, an electric wire connection part 33 to be connected to an electric wire 34, and a U-shaped coupling 37 continuous with the terminal connection part 31 and the electric wire connection part 33. The terminal fitting 30 is accommodated sideways in the cavity 13 with the exposed electric wire 34 facing in toward the center of the housing.

The terminal connection part 31 has three holding strips. Proximal portions of the three holding strips are continuous with each other and are curved annularly to dispose the three strips in three directions. Thus, the holding strips hold the male terminal fitting in three directions and connect electrically to the mating male terminal fitting. An elastic holding strip 32 winds around the periphery of the terminal connection part 31 and deforms elastically to such an extent that the male terminal can be inserted therein.

The electric wire connection part 33 has two barrel strips that extend from both side edges of a bottom plate to define a U-shape. The barrel strips are crimped to an exposed core at the end of the electric wire 34.

The electric wire 34 has the core with a large number of metal strands and insulating coating formed on the periphery of the core. The insulating coating is peeled at the end of the electric wire 34 to expose the core. A rubber stopper 35 is fit on the electric wire 34. The rubber stopper 35 is fit in a stepped large diameter rear portion of the cavity 13 to seal a gap between the electric wire 34 and the cavity 13. A back retainer 36 is fit on the electric wire 34 rearward of the rubber stopper 35 to keep the rubber stopper 35 in the terminal fitting holding part 12.

Figure 9:
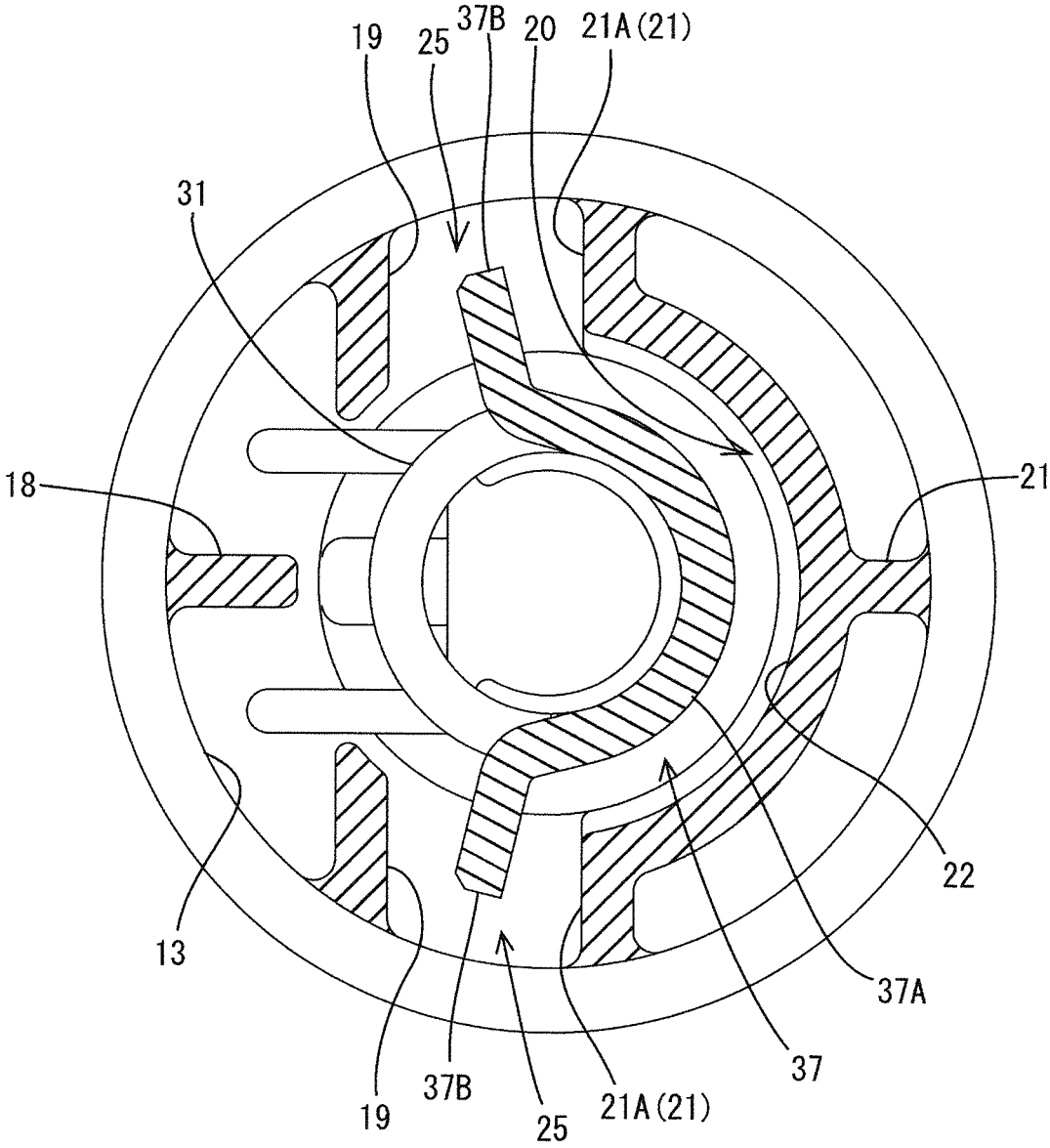
FIG. 9 shows the terminal fitting in the cavity at a correct position.

As shown in FIG. 9, the coupling 37 has a U-shaped portion 37A and the two locking strips 37B that project out from both sides of the U-shaped portion 37A. A front end of the U-shaped portion 37A is continuous with one of the holding strips of the terminal connection part 31, whereas a rear end of the U-shaped portion 37A is continuous with the bottom plate of the wire connection part 33. The locking strips 37B, 37B are symmetrical in the left-to-right direction (vertical direction in FIG. 9). The front edge of each locking strip 37B is round. Each locking strip 37B inclines up (left side in FIG. 9) from the side edge of the plate-shaped portion 37A with respect to the horizontal direction (vertical direction in FIG. 9) with the front side thereof projected out.

As shown in FIG. 8, the shielding shell 40 is mounted on the housing 11 by fitting the shielding shell 40 on the housing 11 from the rear. A fixing part is formed on the shielding shell 40 and has a bolt insertion hole to fix the shielding shell 40 to a shielding shell of the male connector.

Figure 10:
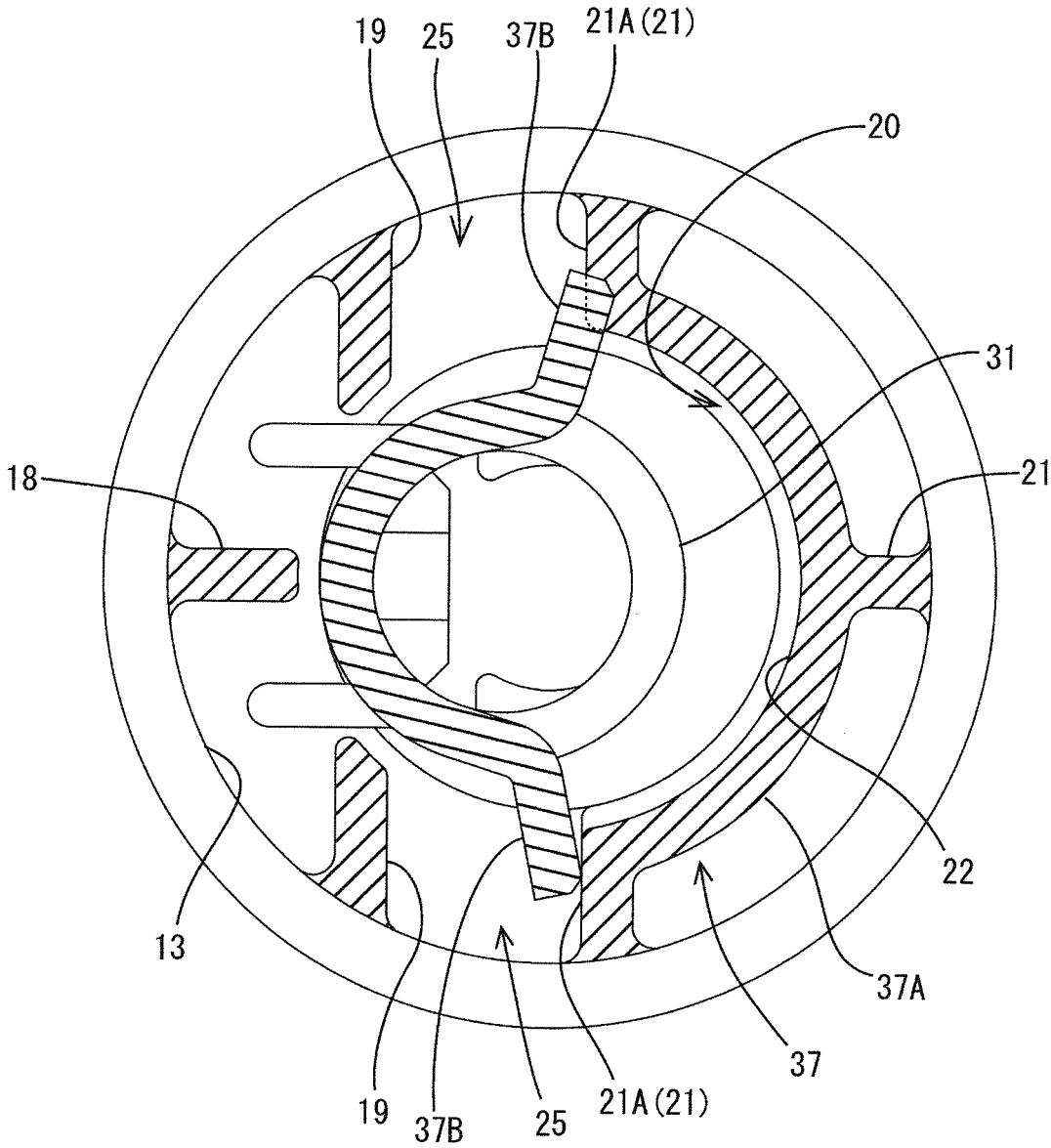
FIG. 10 shows the terminal fitting in the cavity in an inverted posture.

An attempt may be made to insert the terminal fitting 30 into the cavity 13 in an inverted orientation, as shown in FIG. 10. However, the front edge of the locking strip 37B of the terminal fitting 30 contacts the rear edge of the erroneous insertion prevention part 22A of the annular coupling 22 to prevent further insertion of the terminal fitting 30. Thus, the operator can recognize that the terminal fitting 30 has been erroneously inserted into the cavity 13.

The first and second rotation prevention parts 19 and 21A guide the locking strip 37B of the terminal fitting 30 when the terminal fitting 30 is inserted into the cavity 13 in a correct rotational orientation about the axis thereof, as shown in FIG. 9. As a result, the locking strip 37B passes between the first and second rotation prevention parts 19 and 21A. The terminal fitting 30 elastically deforms the lance 17, but the lance 17 elastically returns to its original state when the terminal fitting 30 reaches the normal position. Hence, the lance 17 engages the rear edge 31A of the terminal connection part 31 to resist a force on the terminal fitting 30 in a removal direction.

The locking strip 37B of the terminal fitting 30 engages the first or second rotation prevention part 19 or 21A if the terminal fitting 30 rotates on its axis, as shown in FIG. 11. Thus, the terminal fitting 30 is prevented from rotating more than a predetermined angle, and the terminal fitting 30 cannot rotate enough for the rear edge 31A of the terminal connection part 31 to separate from the lance 17. Accordingly, the terminal fitting 30 remains locked in the cavity 13 despite the limited amount of rotation.

The terminal fitting 30 has the outwardly projecting locking strip 37B. Additionally, the inner surface of the cavity 13 has the erroneous insertion prevention part 22A that engages the locking strip 37B to prevent insertion of the terminal fitting 30 into the cavity 13 in an erroneous rotational orientation about the axis thereof. Therefore the terminal fitting 30 cannot be inserted into the cavity in an improper rotational orientation.

The peripheral surface of the terminal fitting 30 and the inner surface of the cavity 13 are round. The lance 17 projects from the inner surface of the cavity 13 and engages the rear edge 31A of the terminal fitting 30 when a force in the removal direction acts on the terminal fitting 30. The inner surface of the cavity 13 has the first and second rotation prevention parts 19 and 21A to engage the locking strip 37B when the terminal fitting 30 is in the cavity 13 to prevent the terminal fitting 30 from rotating about its axis more than the predetermined amount. Thus, the terminal fitting 30 is prevented from rotating about its axis more than the predetermined amount. Therefore, the rear edge 31A of the terminal connection part 31 cannot unlock from the lance 17 and the terminal fitting 30 cannot be removed from the cavity 13.

The rotation prevention parts 19 and 21A extend from the position corresponding to the position of the locking strip 37B when the terminal fitting 30 is accommodated in the cavity 13 in the proper rotational orientation. Thus, the rotation prevention parts 19 and 21A guide the terminal fitting 30 into the cavity 13.

The erroneous insertion prevention part 22A and the second rotation prevention part 21A are formed unitarily on the inner surface of the cavity 13 as the annular coupling part 22, the erroneous insertion prevention part 22A and the second rotation prevention part 21A can be easily formed.

The locking strips 37B projects to both the left and right. Thus, the locking strips 37B can be locked easily to the erroneous insertion prevention part 22A, and the erroneous insertion prevention part 22A can be formed in a small region (angle).

The locking strips 37B are symmetrical in the left-to-right direction and incline up. Therefore, the locking strip 37B easily can be blocked by the erroneous insertion prevention part 22A when the terminal fitting 30 is inserted into the cavity 13 upside down.

The terminal fitting 30 has the terminal connection part 31 to connect to the mating male terminal fitting, the electric wire connection part 33 to connect to the electric wire 34, and the coupling 37 continuous with the terminal connection part 31 and the electric wire connection part 33. The locking strip 37B is unitary with sides of the coupling 37. Thus, the locking strip 37B can be formed easily in producing the terminal fitting 30.

The invention is not limited to the embodiments described above with reference to the drawings. For example, the following embodiments are also included in the scope of the invention.

In the above-described embodiment, the connector 10 has a female housing in which the female terminal fitting 30 is accommodated. The invention is not limited to this form, and may be applied to a male housing with a male terminal fitting.

In the above-described embodiment, the peripheral surface of the terminal fitting 30 and the inner surface of the cavity 13 are round. The invention is not limited to this form, and may be applied to a connector with at least one of the peripheral surface of the terminal fitting 30 and the inner surface of the cavity 13 is round.

In the above-described embodiment, the locking strip 37B is inclined up, but the locking strip 37B may be inclined down.

The above-described terminal fitting 30 has two locking strips 37B. However, the terminal fitting 30 may have one locking strip 37B. In this case, the range of the erroneous insertion prevention part 22A is larger than that described above, it is possible to prevent erroneous insertion of the terminal fitting 30 into the cavity 13. The rotation prevention parts 19, 21A prevent rotation of the terminal fitting 30 even when the rotation prevention parts 19, 21A are not paired.

In the above-described embodiment, the locking strip 37B is on the coupling 37 of the terminal fitting 30. However, the locking strip 37B may project from another portion of the terminal fitting 30.

What is claimed is:

1. A connector comprising:

a housing having a cavity; and a terminal fitting accommodated in the cavity, left and right locking strip projecting out on the terminal fitting, the left and right locking strips being symmetrical in a left-to-right direction and inclining relative to one another; and an erroneous insertion prevention part formed in the cavity and configured to engage the locking strip when the terminal fitting is inserted into the cavity in an erroneous rotational orientation about an axis of the terminal fitting, thus preventing erroneous insertion of the terminal fitting into the cavity.

2. The connector of claim 1, wherein at least one of a peripheral surface of the terminal fitting and an inner surface of the cavity is round.

3. The connector of claim 2, wherein a lance projects from the inner surface of the cavity; and the terminal fitting has an engagement part engaging the lance when a force in a removal direction is generated.

4. The connector of claim 3, wherein the inner surface of the cavity has at least one rotation prevention part disposed to engage the locking strip when the terminal fitting is in the cavity for limiting rotation of terminal fitting about the axis.

5. The connector of claim 4, wherein the rotation prevention part extends from an insertion opening into the cavity to a position adjacent the locking strip when the terminal fitting is accommodated in the cavity.

6. The connector of claim 4, wherein the erroneous insertion prevention part and the rotation prevention part are unitary with an inner surface of the housing.

7. The connector of claim 1, wherein the terminal fitting comprises of a terminal connection part to be connected to a mating male terminal fitting, an electric wire connection part to be connected to an electric wire, and a coupling continuous with the terminal connection part and the electric wire connection part, locking strip being unitary with a side edge of the coupling.

8. A connector comprising:

a housing with opposite front and rear ends spaced apart along a front to rear direction and at least one cavity extending between the front and rear ends, at least two rotation prevention parts extending substantially in the front to rear direction and being spaced from one another to define at least one pass through channel therebetween, at least one erroneous insertion prevention part unitary with at least one of the rotation prevention parts; and a terminal fitting, at least one locking strip projecting out on the terminal fitting and configured to enter the pass through channel when the terminal fitting is oriented properly relative to the housing and configured to engage the erroneous insertion prevention part when the terminal fitting is oriented improperly relative to the cavity for preventing erroneous insertion of the terminal fitting into the cavity, at least part of the terminal fitting being substantially cylindrically generated and the erroneous insertion prevention part defining part of a substantially cylindrical shape for slidably receiving the terminal fitting when the terminal fitting is oriented properly relative to the cavity, the pass through channel and the locking strip being dimensioned to permit limited rotation of the terminal fitting in the cavity.

9. The connector of claim 8, wherein the at least one locking strip comprises left and right locking strips.

10. The connector of claim 9, wherein the left and right locking strips are symmetrical in a left-to-right direction and incline relative to one another.

11. The connector of claim 8, wherein a lance projects from the inner surface of the cavity, and the terminal fitting has an engagement part, the lance being engageable in with the engagement part to lock the terminal fitting in the cavity, the pass through channel and the locking strip being dimensioned to limit the rotation of the terminal fitting in the cavity to a range where the lanceremains engaged with the engagement part.

12. The connector of claim 8, wherein the at least one locking strip comprises two locking strips and the at least one pass through channel comprises two pass through channels.

13. A connector, comprising:

a housing with opposite front and rear ends spaced apart along a front to rear direction and at least one cavity extending between the front and rear ends, at least two rotation prevention parts extending substantially in the front to rear direction and being spaced from one another to define at least one pass through channel therebetween, at least one erroneous insertion prevention part unitary with at least one of the rotation prevention parts; and a terminal fitting, locking strips projecting out on the terminal fitting and aligned in planes that intersect one another, the locking strips being configured to enter the pass through channel when the terminal fitting is oriented properly relative to the housing and configured to engage the erroneous insertion prevention part when the terminal fitting is oriented improperly relative to the cavity for preventing erroneous insertion of the terminal fitting into the cavity.

14. The connector of claim 13, wherein at least part of the terminal fitting is substantially cylindrically generated and wherein the erroneous insertion prevention part defines part of a substantially cylindrical shape for slidably receiving the terminal fitting when the terminal fitting is oriented properly relative to the cavity.

15. The connector of claim 14, wherein the pass through channel and the locking strip are dimensioned to permit limited rotation of the terminal fitting in the cavity.

* * * * *